US005283805A

United States Patent [19]

Kawano et al.

[11] Patent Number: 5,283,805

[45] Date of Patent: Feb. 1, 1994

[54] SEGMENTED COLD-WALL INDUCTION MELTING CRUCIBLE

[75] Inventors: Hitoshi Kawano; Masanori Tsuda, both of Ise; Yasuhiro Nakai, Mie, all of Japan

[73] Assignee: Shinko Denki Kabushiki Kaisha, Tokyo, Japan

[21] Appl. No.: 961,362

[22] Filed: Oct. 15, 1992

[30] Foreign Application Priority Data

Oct. 16, 1991 [JP] Japan ..... 3-294848
Oct. 9, 1992 [JP] Japan ..... 4-296667

[51] Int. Cl.[5] ..... H05B 5/16; H05B 11/00

[52] U.S. Cl. ..... 373/156; 373/72; 373/155; 373/158; 75/10.14; 164/68.1

[58] Field of Search ..... 373/156, 154, 155, 158, 373/151-153, 71, 72, 75, 76; 75/10.14, 10.18, 65 R, 84; 164/68

[56] References Cited

U.S. PATENT DOCUMENTS

| | | | |
|---|---|---|---|
| 3,223,510 | 12/1965 | Schippereit . | |
| 3,461,215 | 8/1969 | Reboux | 373/157 |
| 3,702,368 | 11/1972 | Hukin . | |
| 3,709,678 | 1/1973 | Helary et al. | 75/10 R |
| 3,775,091 | 11/1973 | Clites et al. | 75/65 |
| 4,038,201 | 7/1977 | Hargreaves | 252/300 |
| 4,058,668 | 11/1977 | Clites | 373/157 |
| 4,432,093 | 2/1984 | Reboux | 373/157 |
| 4,738,713 | 4/1988 | Stickle et al. . | |
| 4,838,933 | 6/1989 | Paillere et al. | 75/10.14 |
| 4,873,698 | 10/1989 | Boen | 373/156 |
| 4,923,508 | 5/1990 | Diehm et al. | 75/10.14 |
| 5,058,127 | 10/1991 | Garnier et al. | 373/157 |
| 5,084,091 | 1/1992 | Yolton | 75/336 |
| 5,090,022 | 2/1992 | Mortimer | 373/156 |
| 5,109,389 | 4/1992 | Stenzel | 373/156 |

FOREIGN PATENT DOCUMENTS 2302586 12/1990 Japan .

*Primary Examiner*—Bruce A. Reynolds
*Assistant Examiner*—Tu Hoang
*Attorney, Agent, or Firm*—Oblon, Spivak, McClelland, Maier & Neustadt

[57] ABSTRACT

In a segmented water-cooled induction melting crucible mainly used for melting special metals such as reactive metals or alloys, two adjacent segments are coupled as a segment having two legs, one leg having an inlet water passage and the other leg having an outlet water passage, so that these water passages form a one-way water flow path when they are connected. When the two legs are connected at their top portion to form a shorted portion, the lower end of the legs are insulated from each other and from a base forming a bottom of the crucible. Alternatively the two legs can be entirely separated by elongating the slit and the water passage formed in each leg can be connected throgh an insulative, connecting member. In either case, the water pasage in each leg can be reduced to the same size as the inner tube in each segment of a conventional crucible, and by virtue of this construction, both the radial thickness and the width of each segment can be reduced which enables an increase the number of segments in a crucible with the same inner space.

6 Claims, 9 Drawing Sheets

SEGMENTED COLD-WALL INDUCTION MELTING CRUCIBLE

BACKGROUND OF THE INVENTION

1. Field of the Invention

The present invention relates to induction melting crucibles generally called as segmented cold wall induction melting crucible having construction suitable for melting metals and alloys called special metals mentioned below, and more particularly to improved crucible body construction including side wall and base portion.

The special metals referred to above can be classified into the following three types, that is, 1) high purity metals and alloys known to be semiconductor materials, 2) reactive metals such as titanium, zirconium(Zr) and their alloys which are difficult to melt as high purity products due to their chemical properties being liable to react with oxygen and nitrogen, and 3) metals having very high melting temperature such as tungsten(W), molybdenum(Mo), tantalum and niobium.

2. Discussion of the Prior Art

Heretofore, special metals and alloys referred to above have been melted using electron beam melting furnace, a nonconsumable electrode arc furnace or the like, however these furnaces have revealed some problems in melting the above-mentioned high purity or reactive metals and alloys which are difficult to melt, for instance, with an electron beam melting furnace it is necessary to restrict its melting atmosphere so as to be lower than $10^3$ Torr, and thus induction melting techniques have been widely used in place of the electron-beam melting by virtue of the simple construction requested together with covenient ways of use.

Among various induction melting furnaces, cold wall induction melting (alternately referred to as cold-crucible induction melting,induction skull melting or the like) has been widely adopted as a melting method suitable for melting the aforesaid special metals and alloys.

A cold wall induction crucible which has generally been used heretofore, as typically shown in FIGS. 7A and 7B, is a metal crucible used for induction melting comprising; a main crucible body 1 made of metals having good thermal and electrical conductivity mainly of copper and formed to have a shape generally of hollow cylinder with a bottom, the side wall of which or even the entire side wall and a part of the base portion being divided into a plurality of segments 3 by a plurality of slits 2 separating adjacent segments 3, and an induction heating coil 8 surrounding the crucible main 1, wherein the interior of each segment 3 is cooled by a cooling medium such as water.

Next, an explanation will be provided as to the process of melting the metallic material charged in the cold wall type induction melting crucible.

A metal or metals and or master alloys to be melted are charged into the crucible chamber in the form of lumps, granules, plate-like, powder mixtures thereof or the like.

Upon starting of induction melting, the charged materials start melting beginning from the outer surface thereof and the molten metal flows down toward the bottom of the crucible, where it solidifies as a skull of a shallow dish-like configuration acting as a second metellurgical vessel holding thereon the molten metal and the charge not yet melted.

As the amount of molten metal increases due partly to stirring caused by the rather high frquency of the power than that supplied to ordinary induction melting process, the level of the molten metal rises and the skull formed around the inner surface of the segments also grows upward and forms a side wall of the skull upstanding integral with the dish-like bottom part and constitutes a metallurgical vessel like a pan, which prevents molten metel from directly adhering to the side wall of the segments and entering into the slits and contains therein the increased amount of molten metal and the charge still remaining unmelted.

As melting further proceeds until the whole of the charge has melted down, the level of the molten metal also rises so as to constitute a molten pool of the charged metal.

Under this condition, central part 9*a* of the molten metal 9 along the vertical axis of the crucible body is raised upward, while the peripheral portion of the molten metal 9 is lowered along the side wall of the crucible to form a convex curved surface as shown in FIG. 7A, thereby the molten metal generally leans away from contact with the inner face of the segments 3, thereby preventing any of the adjacent water cooled segments 3 electrically insulated from each other by respective slits from being shorted by the molten metal.

Copper is selected as the material suitable for forming a crucible in place of a usual refractory material. By virtue of its high thermal and electrical conductivity, segments made of copper forming a side wall of the crucible when cooled by a suitable cooling medium such as water, can be held at a temperature considerably lower than that of the molten metal received therein.

Since the crucible is constructed as explained above, the crucible itself will never reach such a high temperature at which it reacts with the metal or metals to be melted so that undesirable chemical compounds are formed which would contaminate the molten metal as usually encountered in crucibles made of refractory material which are impossible to water cool.

Instead, since the substances to be melted are limited only to those materials charged into the crucible, inclusion of impurities can be avoided thereby giving rise to high purity products, and moreover the uniformity in the melting process also can be attained by virtue of a stirring action which is a feature of induction melting.

On the other hand, due to the high electrical conductivity there is such another problem that the crucible itself is liable to be induction heated, but the possibity of the crucible being heated as a secondary coil with respect to a primary induction coil up to such a high temperature as mentioned above, can be avoided by splitting the crucible wall vertically into a plurality of segments each having therein a hollow cylindrical chamber into which a cooling medium such as water is introduced for cooling each segment.

However, it is still inevitable for the segments, due to their good electrical conductive properties, to be heated to some extent by the primary induction heating coil in a manner similar to the material to be melted.

Actual measurements have revealed that, if the amount of power used for melting the material charge is assumed to be a value of one (1) the power used for heating the crucible was found 1,3, and as result it has been roughly estimated that only 40% of the input power was utilized for melting charged material.

It is considered effective, as a measure for reducing the extent of heating for the water cooled segments themselves, to reduce the radial wall thickness of each segment, however, each water cooled segment of conventional type, as shown in FIGS. 7A and 7B, is a double tube construction having both an inlet passage and an outlet passage in a single segment, that is, cylindrical hallow tube 11 further receives therein an inner tube 11*a*, and as a consequence there is a restriction for reducing the radial thickness of each segment in the radial direction.

On the other hand, the greater the number of segments disposed, the less becomes the chance that each segment is heated, and the magnetic flux density adjacent to the wall of the crucible becomes more uniform which contributes to stabilize the molten metal, however, there still remains the same restriction as mentioned above due to the restriction for reducing the wall thickness in the radial direction.

SUMMARY OF THE INVENTION

By taking the above-mentioned problems of the conventional segmented cold-wall induction melting crucible into account, an object of the the present invention is to provide a segmented cold wall crucible capable of reducing both the radial and circumferential wall thickness of each segment and of incresing the number of segments in a crucible as compared with a conventional crucible of the same size.

A further object of the present invention is to provide a segmented cold-wall induction melting crucible wherein attenuation of the applied power can be reduced by virtue of the novel structural features of the present invention.

1) According to the present invention, the structure of each segment, as shown in FIG. 8A, is composed generally of a pair of two adjacent segments 3A and 3B which are connected one after another to constitute a unit segment, and the segments 3A and 3B are connected integrally at their top portion to constitute a connected, namely a shorted portion 3C, the portion of the segment lower than the shorted portion 3C is separated by a slit 2A into the segments 3A and 3B.

The slit 2A has a height starting from the lower end of the shorted portion 3C down to the lower end of the segment.

Each segment, as shown in FIG. 8B, is formed to have an elongated upwardly directed hole, and the two holes in the unit segment are communicated through a passage formed in the shorted portion.

In this way, cooling water is introduced to the lower end of one hole and supplied to the upper end of the other hole via the passage in the shorted portion and then discharged from the bottom end of the other hole.

By virtue of this twin type segments, each segment has only to have a single small hole having an inner diameter almost the same as that of the inner tube 11*a* of the segmented cold-cruciblle of the conventional type, thereby both the width and the radial thickness of each segment can be reduced.

2) However, due to the fact that the two adjacent segments are connected at their top portion to constitute a unit segment, there would arise another problem of inducing a current circulating the two segments as a closed loop circuit as shown in FIG. 8A, if the bottom of the unit segments having been connected at their top portion are connected to constitute an integral crucible base, or the bottom end of each segment separated by respective slits is simply connected to a conductive base member to form a crucible bottom.

A closed loop electric circut is established, in which current flows as follows;

left segment 3A→ upper shorted portion 3C→ right segment 3B→ conductive base portion 4, and returning to left segment 3A, and therefore, when an induction coil is energized by a current flowing through the closed circuit, namely, the current C circulating around the the slit 2A is established and thereby a magnetic field generated by the current C attenuates the magnetic flux from the induction coil passing through the slit to enter into the metals to be melted in the the crucible.

In order to prevent the current circulating around the slit from forming, the following measures have been taken:

a) An insulating member has been interposed between the lower end of the foot portion 5A of each leg portion 3A(3B) of each segment and the conductive base member 4, so that the lower end of the foot portion 5A can be electrically insulated from the base member.

b) As an alternative, the slit is further extended beyond the connected portion, in other words, the two segments 3A and 3B themselves are not conected as an integral member, but they are placed upstanding side by side being spaced apart by a slit and the respective water passages 11*a* and 11*b* are connected at their upper portion by a connecting member of insulating material, so that these two segments are insulated from each other for preventing them from forming paths of circulating current.

Based on the above-mentioned technical concept for solving the pending problems, the inventors of the present invention have filed a Japanese Patent Application entitled "Crucible Structure of a Cold-Wall type Melting Furnace" with a filing date of Oct. 16, 1991(Japanese Patent Application No.Hei 3-294848).

However, due to the provision of the connected portion according to the aforesaid aspect a), it was found later that some problems occured, particularly either in a massive columnar body of unexpectedly solidified charged metal due to abnormal events such as a stoppage of the electric current or other problems in the melting means, or in an ingot intentionally formed in the crucible, similar troubles are also encountered in the skull remaining in the crucible even after normal pouring of the molten metal from the crucible.

In more detail, the massive columnar body or ingot 5 is shaped as shown in FIG. 9A, while the skull 5' remaining in the crucible is shaped as a hollow thin cylinder 5 having a protrusion 5*b* like a tongue on a part of the top end as shown in FIG. 9B.

Both the massive columnar body or ingot 5 and the skull 5' have a number of somewhat linear and low raised portions 5*a* like mountain ridges, formed on the outer surface thereof and extending vertically along the vertical axis of the crucible.

These raised portions 5*a* in the former type are formed when the molten metal partly encroaches into the slits and solidifies in situ undesirably or intentionally, while the raised portions 5*b* of the skull of the latter type are formed in a similar manner even when the molten metal is poured through a pouring port of the crucible in a normal step of pouring.

If such raised portions have once formed, it becomes very difficult or even impossible to pull out the thus solidified matter outside the crucible, as a consequence, a crucible of the type is required to solve the problem.

The inventors of the present invention have solved the aforesaid problem by forming a vertically extending shallow groove on the inner surface of the connected portion of each paired segment, which groove is formed as the extension of the slit between two legs of the paired unit segment having a depth less than the radial thickness of the connected portion but sufficient to pass through the raised portion of the above-mentioned solidified matter.

According to the present invention, the segmented cold-wall crucible comprises, a plurality of unit segments each formed by joining two adjacent segments at their top portion as a connected or a shorted portion, but at the portion under this connected portion down to the lower end, each segment is separated from the other by a slit and has formed therein a single hole as a water passage so that two of the single holes in each segments are connected by a communication passage formed in the connected portion so as to constitute a one-way water passage for flowing cooling water from the bottom of one segment to the bottom of the other segment via the communication passage, thereby the single hole formed in each segment only has to have an inner diameter almost equal to that of the inner tube formed in each segment of a conventional type having a double tube structure, and thus both the thickness and the width of each tube can be made smaller and the power supplied to the melting unit can be remarkably reduced.

It is also possible to increase the number of segments to be arranged in a crucible, and the flux density adjacent to the side wall of the crucible becomes more uniform which enhances stability of the molten metal in the crucible.

The other objects and features of the present invention will become apparent from the following description with reference to the accompanying drawings.

DESCRIPTION OF THE PREFERRED EMBODIMENTS

Figure 1:
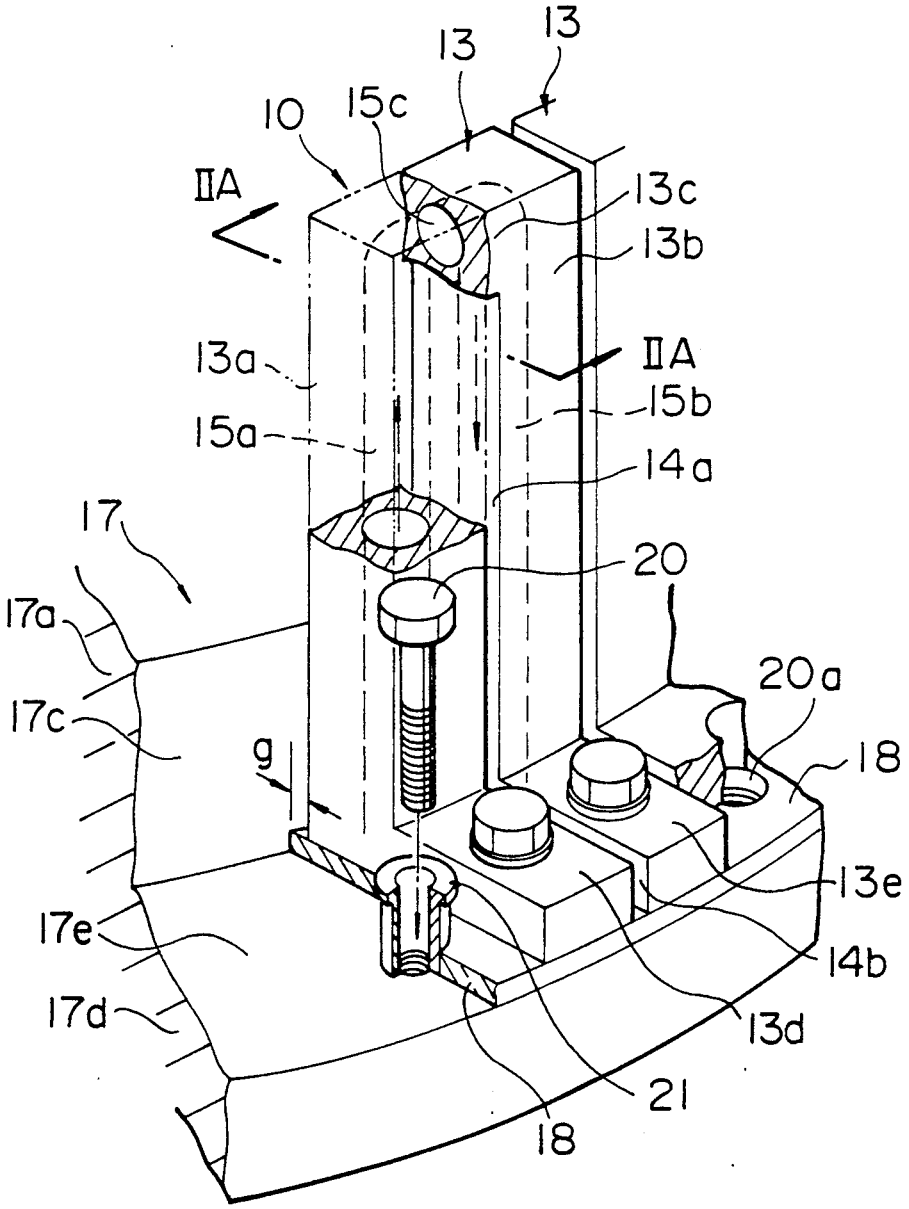
FIG. 1 is a fragmented perspective view showing a first embodiment of the present invention.
Figure 2A:
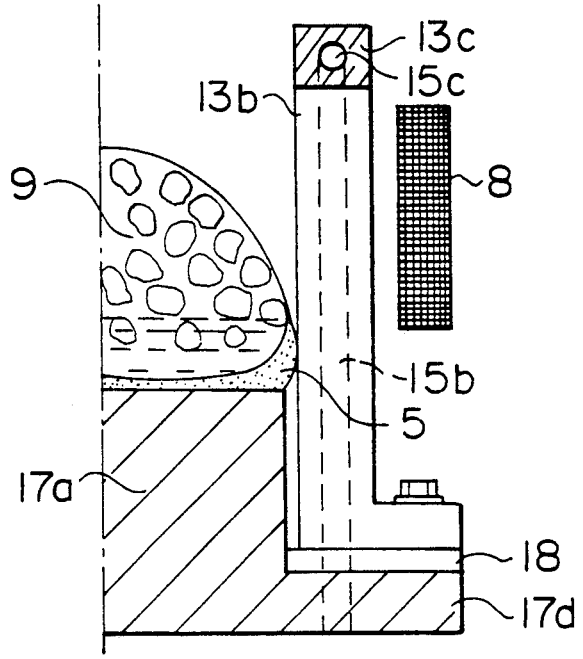
FIG. 2A is a schematic sectional side view of one half of the segmented cold-wall crucible taken along IIA—IIA of FIG. 1.
Figure 2B:
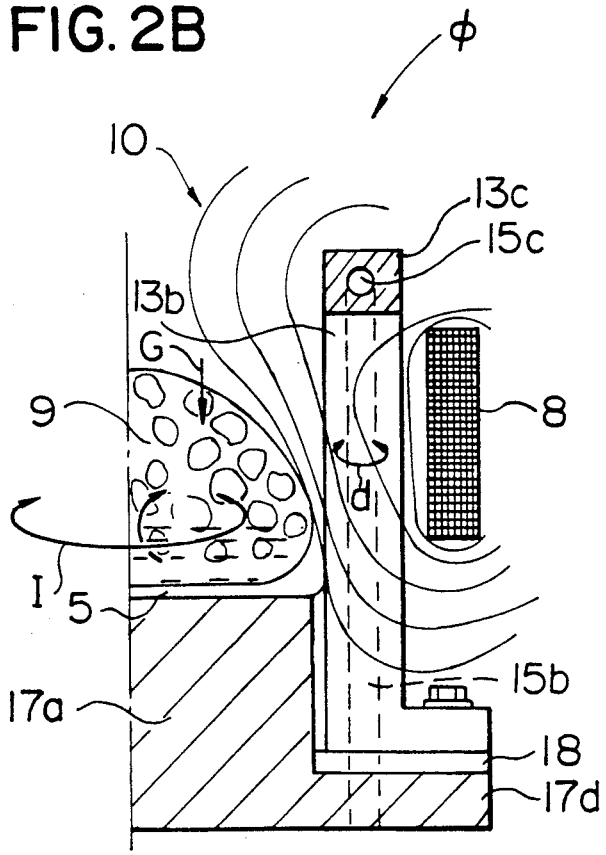
FIG. 2B is a schematic sectional side view of the one-half part of the segmented cold-wall crucible shown in FIG. 2A and with magnetic lines of force.

FIG. 1 is a partial perspective view showing a part thereof being sectioned to show a first embodiment of the invention, and FIGS. 2(A) and 2(B) are reduced scale side views taken along IIA—IIA of FIG. 1.

Numeral 10 in the drawings shows an entire part of the cold wall induction melting crucible according to the present invention and numeral 13 designates a unit segment by joining two adjacent segments into a pair.

Each unit segment 13 consists of a left leg 13*a* and a right leg 13*b* in the drawing, and these two legs are joined at their top portion to constitute a shorted portion 13*c*, lower parts thereof are separated by a slit 14*a* to define the two legs 13*a* and 13*b* mentioned above, in each of which legs a hole 15*a* or a hole 15*b* is formed through the axially central part thereof from the bottom of each leg and up to the joined portion and each of the two holes is used either as an inlet hole or an outlet hole for the passage for cooling water when these two holes are connected by a communication hole 15*c* opened almost horizontally through the joined portion 13*c*.

Figure 3:
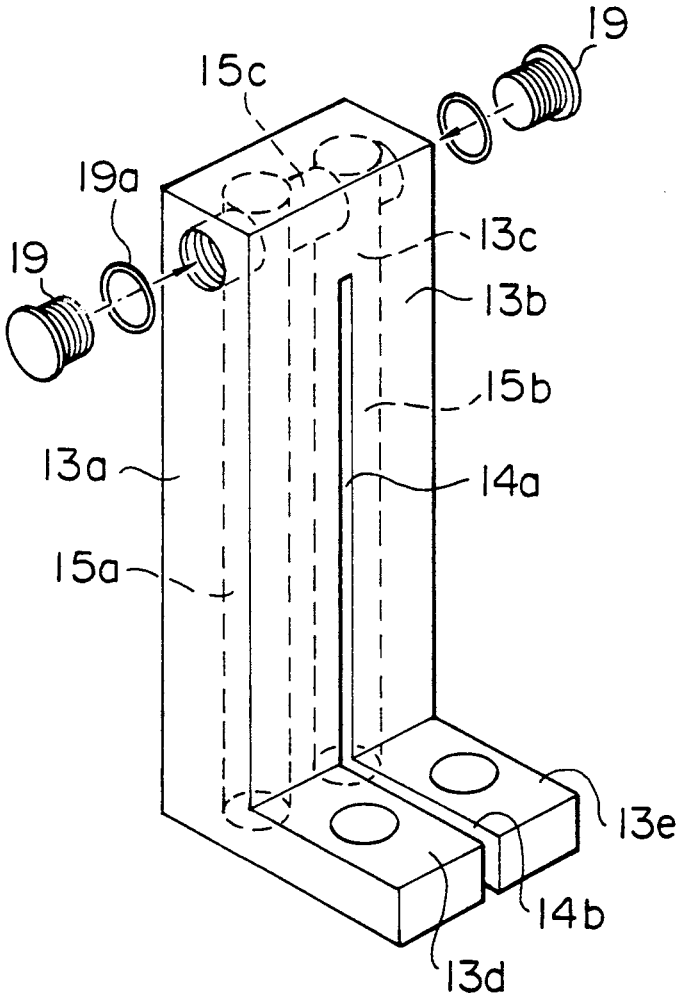
FIG. 3 is a perspective view showing a unit segment shown in FIG. 1.

FIG. 3 shows a practical structure for fluid-tightly connecting the inlet hole 15*a* and the outlet hole 15*b*.

Each of these inlet hole 15*a* and the outlet hole 15*b* is formed, respectively, by upwardly drilling respectively leg 13*a* and 13*b* from their bottom end up to the place slightly lower than the upper end of the communication hole 15*c* is to be opened, then the communication hole 15*c* is drilled horizontally from both opposite outer ends of the legs 13*a* and 13*b* so that these two holes can reach and pass through the upper part of each hole and meet with each other and constitute a single communication hole 15*c*, the outermost open ends of which are fixed, spectively, with a closure member 19 and is sealed by an O ring in a water tight manner.

Respective lower ends of leg 13*a* and 13*b* are each formed so as to have an integrally affixed and radially, outwardly extending foot 13*d* or 13*e*. A slit 14*b* is defined between feet 13*d* and 13*e* communicating with the slit 14*a* between the legs 13*a* and 13*b*. When the whole unit segment is assembled, the feet 13*d* and 13*e* constute flanges intermittently disposed at the lower end of the side wall of the crucible, thereby these flanges are placed on an annular flange of the base 17 at the base 17 of the crucible as explained later in greater detail.

In FIG. 1 crucible base 17 is fabricated of electrically conductive material constituites the bottom of the crucible and reference numeral 17*a* is a central raised portion forms the bottom of the crucible. The side wall of the crucible which can be formed by the intermittently dispose inner faces of respective pair of legs 13*a*, 13*b* when all the unit segments are assembled together, thereby the bottom and the inner face constitute a crucible chamber.

Reference numeral 17*d* denotes an annular flange extending radially outward from the lower end of the raised portion 17*a* and acts as a flange of the entire crucible 10. The intermittently disposed flanges at the lower part of the legs and the feet of unit segaments are laid so as to be supported by the flange 17*d*.

An annular gap g of a specified distance is formed between the inner face of the unit segments 13 and the outer face 17*c* of the raised portion 17*a* of the base 17 in order to reduce the possibility of any shorting out occuring between adjacent legs across the slit through molten metal inclusive of the skull entering into the slit.

Numeral 18 is an annular insulator plate fabricated of insulating material such as glass or laminated epoxy sheets, through which a specified number of bolt holes are opened.

The insulator plate thus formed is fitted around the outer face 17*c* of the raised portion 17*a* so as to be placed on the upper face 17*e* of the flange 17*d*, onto which feet 13*d* and 13*e* of each unit segment 13 is disposed, then bolts 20 are passed through the feet 13*d* and 13*e* and the insulator plate 18 is placed thereunder and then tightened to the screw hole(not shown) formed on the upper face 17*e* of the flange 17*d*.

This means of insulation is done with the intention of preventing the two adjacent lower faces of the feet 13*d* and 13*e* including the lower ends of legs from shorting out through the upper face 17*e*. Each bolt 20 is also insulated from the foot 13*d* or 13*e* by a T-shaped collar 21 made of a good insulator, so as to prevent an elecric circuit from being closed across the lower end of the slit 14 due to shorting between the flange 17*d* of the base 17 and any foot of the unit segment 13 through the bolt 20.

The operation of the first embodiment of this invention will now be explained hereinbelow.

By supplying an alternating current of specified frequency to an induction heating coil 8, magnetic flux Φ flows around the coil 8 as shown in FIG. 2B.

Magnetic lines of force slightly vary depend on the section cut by a plane passing a specific point on the circle encompassing the segment 13 and the vertical axis of the crucible.

FIG. 2B is a side view showing the magnetic lines of force sectioned at a plane in the slit 14*a* between the two legs 13*a* and 13*b* of a paired unit segment 13.

Since each unit segment 13 is composed of slim legs 13*a* and 13*b*, magnetic flux density formed adjacent to the inner face of the unit segment 13 becomes more uniform as compared with that formed in any conventional type segment.

Charged material to be melted is heated by the current I induced by the aforesaid magnetic flux Φ and is melted and forms a pool of molten metal which, due to the electromagetic interaction between the magnetic flux Φ and due the current I and to the acceleration due to the force of gravity G, is stirred in the crucible. As a consequence, the central part of the molten metal is raised, while the outer peripheral portion along the inner face of the crucible is lowered to form a convex surface.

The molten metal at the portion contacting the bottom 17*a* and the water cooled side wall of the segment 13 solidifies so as to form a thin skin called a "skull" 5.

The current induced by the induction heating coil 8 which would otherwise circulate around the outer surface of the crucible main body does not flow, since it is interrupted by the slit 14 defined between the foot 13*a* and 13*b* of the unit segment 13.

Similarly, the current which would flow through a circuit in the order, left segment 13*a*→ upper shorted portion 13*c*→ right segment 13*b*→ base portion 17, also does not flow, since there is provided the insulating member 18.

As melting further proceeds, the temperature of the segments 13 themselves also s due to thermal radiation and by heat conduction provided by the molten mass and by the partial induction heating inside the segments, but this temperature rise can be reduced to an acceptable extent by increasing the flow rate of the cooling water.

Second Embodiment

Figure 4A:
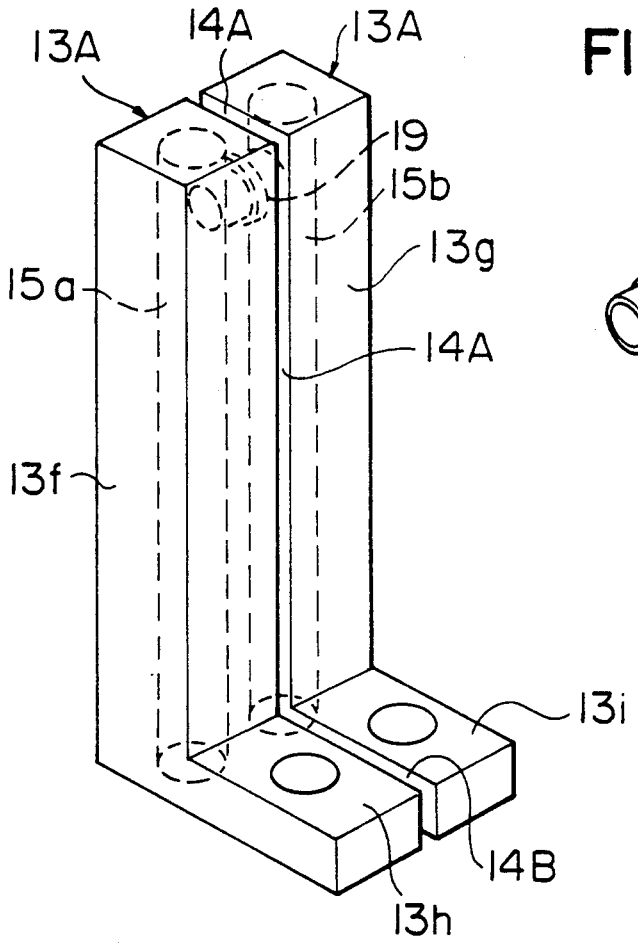
FIG. 4A is a perspective view showing a unit segment of the second embodiment of the invention.

FIG. 4A is a perspective view showing second embodiment of the present invention, in which numeral 13A is a unit segment according to this invention, which differs from the first embodiment with respect to the feature that a slit 14A is further extended upward beyond the upper end extremity of the segment so that left leg 13*f* can be entirely separated from the right leg 13*g*.

Figure 4B:
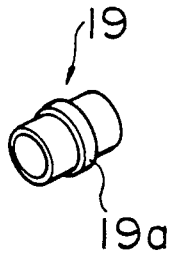
FIG. 4B is a perspective view showing a connecting member for the unit segment shown in FIG. 4A.

The upper ends of an inlet hole 15*a* and 15*b* are opened to the portion slightly below the top end of respective legs 13*f* and 13*g* as in the first Embodiment, and the two water passages are connected by a connecting member 19 interposed at its middle portion by an insulating member 19*a* shown in FIG. 4(B).

Since neither of the legs 13*f* and 13*g* constitute any part of the path of electric current by virtue of the insulation by the connecting member 19, it is not required to insulate the two lower faces of the unit segment 13A from the flange 17*d* of thebase 17, however, if the connecting member 19 is fabricated merely of conductive metal or alloys, the aforesaid mating members are required to be insulated as was done in the first embodiment.

The manner of melting taking place in the crucible according to the present invention is quite similar to that in the first invention, so explanation thereof will not be repeated.

The aspect of the second embodiment differing from that of the first embodiment, resides in that the current induced by the induction heating coil 8, which otherwise would flow following the path, left leg 13*f*→ connecting member 19→ right leg 13*g*→ base 17, does not flow by virtue of the insulating member 19*a* constituting the connecting member 19.

Third Embodiment

Figure 5B:
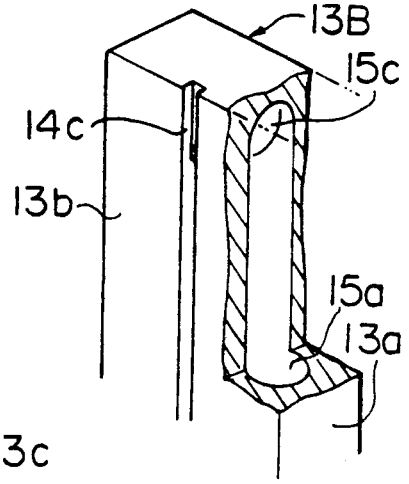
FIG. 5B is a fragmented perspective view on an enlarged scale showing the groove of the light leg shown in FIG. 5A.
Figure 5A:
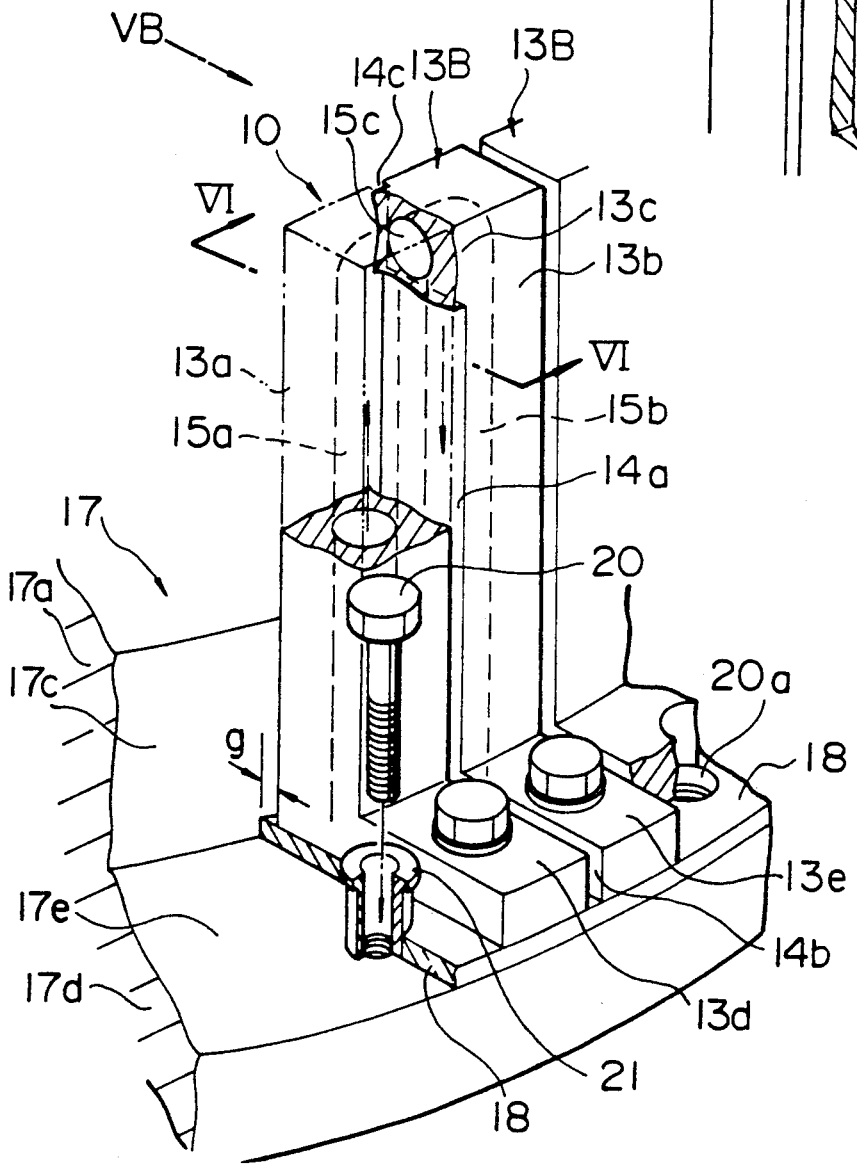
FIG. 5A is a fragmented perspective view showing a third embodiment of the present invention.
Figure 6:
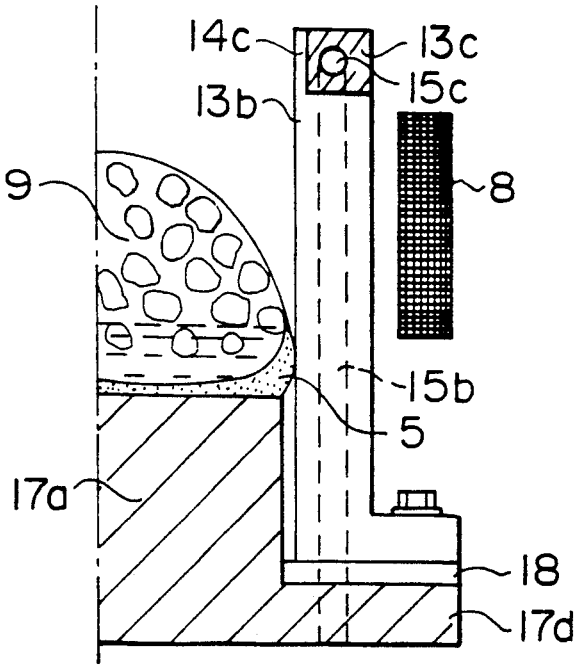
FIG. 6 is a schematic sectional side view of the half part of the segmented cold-wall crucible as taken along line VI—VI of FIG. 5A.
Figure 7A:
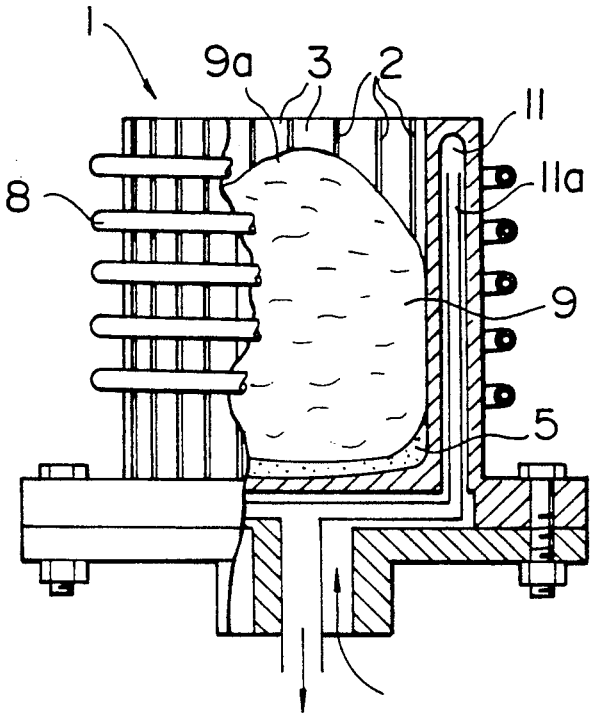
FIG. 7A (PRIOR ART)
FIG. 7A is a side view of a conventional segmented cold-wall crucible.
Figure 7B:
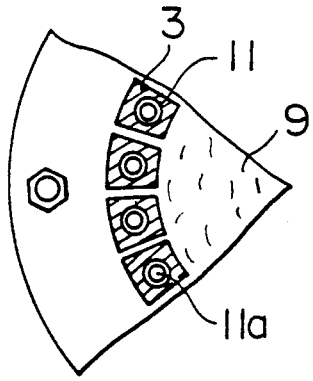
FIG. 7B (PRIOR ART)
FIG. 7B is a fragmented plan view of FIG. 7A.
Figure 8A:
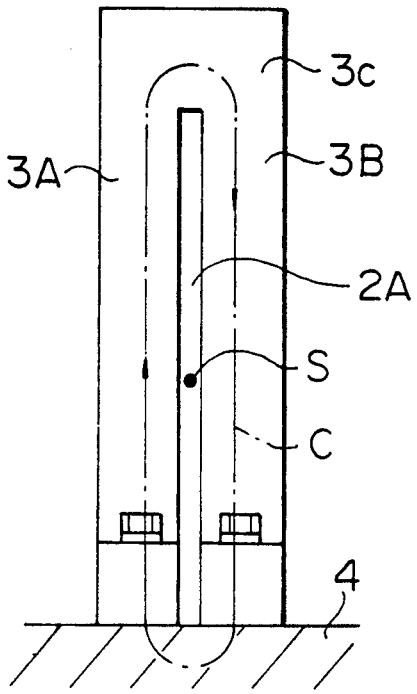
FIG. 8A is a front view of a unit segment of the present invention having two separated legs joined at their top portion but having no insulation at the bottom and which shows a current flowing along the unit segment and a base portion.
Figure 8B:
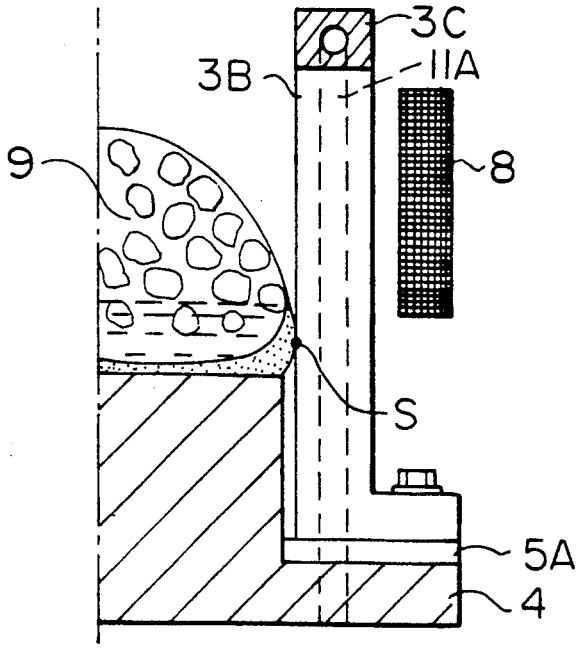
FIG. 8B is a sectional side view cut along a vertical plane passing through both a slit and the vertical axis of the segment.

FIG. 5A is a perspective view showing a third embodiment of the present invention, and FIG. 5B is a partial perspective view on an enlarged scale showing a groove formed as an extension of the slit in the previously explained embodiments.

A shallow groove 14*c* is formed additionally on the inner surface of the shorted portion 13*c* of each unit segment 13B as a partial extension of the slit 14 and having a circumferential width the same as that of the slit 14, a depth exceeding the expectable maximum height of the raised portion 5*a* on the outer surface of an ingot 5, or a skull 5' and a vertical length sufficient to reach the top end of the unit segment, where it partly separates the unit segment 13B.

Figure 9A:
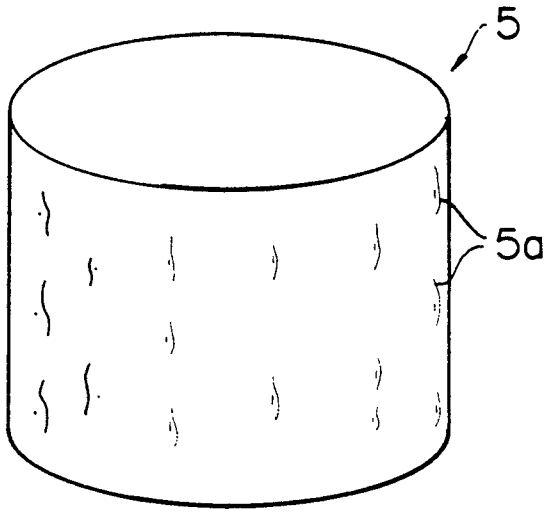
FIG. 9A is a schmatic perspective view showing a vertical raised portion on the outer surface of a solidified columnar body formed in the crucible.
Figure 9B:
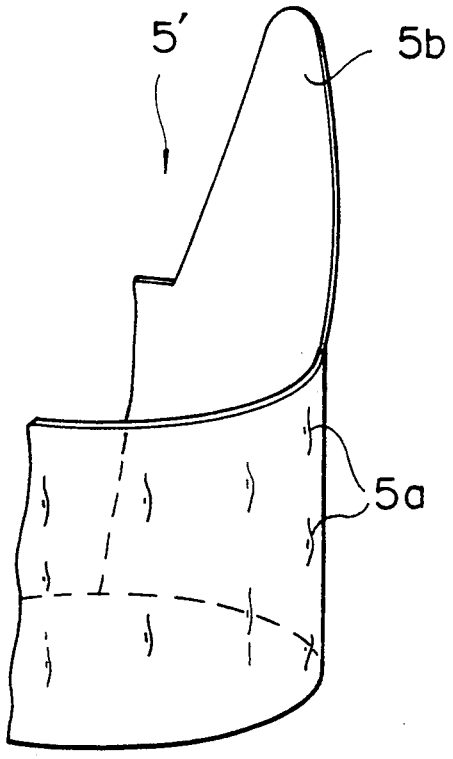
FIG. 9B is a schmatic perspective view showing a vertical raised portion on the outer surface of a skull formed during the pouring.

Referring again to FIGS. 9A and 9B the irregularly shaped raised portions 5*a* are formed so as to be vertically spaced apart at an equal pitch in the circumferential direction due to their manner of formation, that is, they are formed by the molten metal in the crucible having encroached into the uniformly spaced slits in the unit segments as already explained.

In view of the nature of the raised portion 5b as explained above, it will be readily understood that, such undesirable solidified metal body, ingot or skull having such raised portions can be pulled out outside the crucible by passing the raised portions 5a through the groove 14c.

The construction and function other than the provision of additionally formed grooves 14c, is the same as the first and the second embodiment as already mentioned, so further explanation will not be repeated.

A key feature of the present invention resides in that the segmented cold-wall crucible comprises a plurality of unit segments each formed by joining two adjacent segments at their top portion as a connected portion or a shorted portion, but at the portion under this connected (shorted) portion down to the lower end each segment is separated from the other one by a slit, and therein is formed a single hole as a water passage so that the single hole in each of the segments are connected by a communication passage formed in the shorted portion so as to constitute a one-way water flow passage for flowing cooling water from the bottom of one segment to the bottom of the other segment via the communication passage, thereby the single hole formed in each segment only has to have an inner diameter almost equal to that of the slender inner tube formed in each segment of the conventional type of double tube structure, and thus both the thickness and the width of each tube can be made smaller and the power supplied to the melting unit can also be remarkably reduce.

Another feature of this invention is that it is possible to increase the number of segments to be arranged in a crucible, magnetic flux density adjacent to the side wall of the crucible becomes more uniform which enhances stability of the molten metal in the crucible.

Yet another feature of this invention is the substantial amount of insulation applied to various portions of the crucible due to following reasons, firstly, a suitable gap is maintained between the inner face of each unit segment and the outer surface of the central raised portion of the base, secondly, the bottom face of the flanges formed by the pair of legs of each unit segment is insulated from the upper face the flange of the base, thirdly, when the pair of legs of each unit segments are entirely separated by extending the slit beyond the shorted top portion, water passage from one leg to another leg is communicated through a connecting piece interposed by an insulating member.

By means of the insulation, undesirable current circulating the unit segment and/or other related member(s) can be avoided but it still allows magnetic flux generated by an induction heating coil to pass under the slit formed between two legs of the paired unit segment.

Furthermore, in the crucible of the type of the first embodiment using unit segments each having two legs combined and shorted at their top, molten metal may solidify as either one of following types, a solidified massive block due to stoppage of power, an intentionally formed ingot or the like in a crucible or a skull formed at the pouring port during normal pouring, which accompanying a number of low raised portions like ridges of mountains randomly formed by the molten metal having encroached in the slits and solidified in situ, and thus prevent ready pulling out of these solidified matter outside the crucible.

However, these problems can be solved by passing the raised portions through the vertically formed grooves on the inner face of the shorted top portion of the unit segment.

What is claimed is:

1. A segmented cold-wall induction melting crucible, comprising;

a crucible main body composed of a side wall defined by a plurality of intermittently upstanding segments in an array and spaced apart from each other in circumferential direction so as to define a slit of a specified width between adjacent segments, each of said segments being fabricated of an electrically conductive material, a base made of an electrically conductive material and inserted in a space defined by said intermittently upstanding segments and which includes a crucible base contiguous with said side wall, and an induction heating coil disposed around the outer face of said crucible, and generate a magnetic field wherein:

said plurality of segments comprise a plurality of pairs of unit segments, spaced apart from one other with a specified gap and including two adjacent legs spaced apart with said specified gap such that magnetic flux from said magnetic field passes through said gap; and wherein each leg has a contiguously formed foot, one leg of each of said unit segments having an inlet water passage and the other leg having an outlet water passage, said inlet and outlet passages being connected so as to form a one-way flow passage for cooling water and said foot of each leg of said unit segments extending radially outward so as to form an L shaped leg member;

said base including a raised central portion inserted in said space defined by said side wall, and an annular flange extending radially outward from a lower part of said raised central portion for supporting each foot of said plurality of unit segments laid thereon and fixed to said base, and an insulation member mounted on said base for insulating said unit segments from one another and said base.

2. A segmented cold-wall induction melting crucible as claimed in claim 1, wherein said adjacent legs of each unit segments are separated from each other by a slit and are fixed to said base by said insulating member as as to form an electrically shorted portion between said legs.

3. A segmented cold-wall induction melting crucible as claimed in claim 2, wherein said insulation member mounted on said base comprises one of an insulating plate and an insulating sheet fixed to said base by a bolt surrounded by a collar fabricated of insulating material whereby said foot of each of said unit segments is insulated from the flange of said base.

4. A segmented cold-wall induction melting crucible as claimed in claim 1, wherein each of said unit segments comprises two separated legs and wherein a connected member interconnects said water passage in each leg for enabling communication of cooling water from one passage to the other passage.

5. A segmented cold-wall induction melting crucible as claimed in claim 1, wherein each of said unit segments has a connecting member of a conductive material for enabling communication of cooling water from the inlet passage of said one leg to the outlet passage of said other leg and each of said legs of said unit segments are fixed to said base by at least one additional insulating member.

6. A segmented cold-wall induction melting crucible as claimed in claims 2 or 3, wherein each of said legs of said unit segments is separated by a slit which extends to at least half way up to a top portion thereof and each of said legs are connected together by a shorted portion, and wherein the shorted portion has a shallow groove on an inner face portion thereof which extends vertically from a top end portion of said slit to an upper end extremity of said shorted portion and said shallow groove has a width at least as wide as that of said slit.

* * * * *